US005471228A

United States Patent [19]

Ilcisin et al.

[11] Patent Number: 5,471,228

[45] Date of Patent: Nov. 28, 1995

[54] ADAPTIVE DRIVE WAVEFORM FOR REDUCING CROSSTALK EFFECTS IN ELECTRO-OPTICAL ADDRESSING STRUCTURES

[75] Inventors: Kevin J. Ilcisin, Beaverton; Dennis W. Prince, Banks, both of Oreg.

[73] Assignee: Tektronix, Inc., Wilsonville, Oreg.

[21] Appl. No.: 189,999

[22] Filed: Feb. 1, 1994

Related U.S. Application Data

[63] Continuation of Ser. No. 958,631, Oct. 9, 1992, abandoned.

[51] Int. Cl.[6] ..... G09G 3/36

[52] U.S. Cl. ..... 345/58; 345/87; 345/60

[58] Field of Search ..... 345/58, 87, 101, 345/90, 60, 94; 359/55, 61, 54; 348/751, 790

[56] References Cited

U.S. PATENT DOCUMENTS

| | | | |
|---|---|---|---|
| 3,955,187 | 5/1976 | Bigelow | 340/811 |
| 4,485,380 | 11/1984 | Soneda et al. | 359/59 |
| 4,586,039 | 4/1986 | Nonomura et al. | 340/784 |
| 4,833,463 | 5/1989 | Dick et al. | 345/67 |
| 4,845,482 | 7/1989 | Howard et al. | 340/805 |
| 4,892,389 | 1/1990 | Kuijk | 359/58 |
| 4,896,149 | 1/1990 | Buzak et al. | 340/771 |
| 4,945,352 | 7/1990 | Ejiri | 340/805 |
| 5,010,326 | 4/1991 | Yamazaki et al. | 345/94 |
| 5,075,596 | 12/1991 | Young et al. | 345/76 |

FOREIGN PATENT DOCUMENTS

| | | | |
|---|---|---|---|
| 0313876 | 10/1988 | European Pat. Off. . | |
| 2615993 | 5/1988 | France . | |
| 63-307433 | 12/1988 | Japan | 345/58 |
| 4011281 | 1/1992 | Japan | 345/58 |
| 4118625 | 4/1992 | Japan . | |
| 2205432 | 6/1988 | United Kingdom . | |

OTHER PUBLICATIONS

"Eliminating Crosstalk in Thin Film Transistor/Liquid Crystal Displays", W. E. Howard, P. M. Alt, R. L. Wisnieff, 1988 International Display Research Conference.

"Crosstalk–Free Driving Methods For STN–LCS's", Y. Kaneko, M. Haraguchi, H. Murakami and H. Yamaguchi. Proceedings of the SID, vol. 31/4, 1990.

*Primary Examiner*—Ulysses Weldon
*Assistant Examiner*—Lun-Yi Lao
*Attorney, Agent, or Firm*—Michael O. Scheinberg; John D. Winkelman

[57] ABSTRACT

Crosstalk is reduced in any type of active matrix electro-optical display system (10) by applying a compensating signal, the value of which is dependent upon multiple data drive signals. In a preferred embodiment, a single compensating signal, equal to the inverse weighted average of all of the data drive signals applied during a row address period, can be applied to all data electrodes (20) after the data drive signals are stored in display elements (16). Such a compensating signal simultaneously reduces side-to-side crosstalk and front-to-back crosstalk to levels previously achievable for only one type of crosstalk at a time.

25 Claims, 7 Drawing Sheets

ADAPTIVE DRIVE WAVEFORM FOR REDUCING CROSSTALK EFFECTS IN ELECTRO-OPTICAL ADDRESSING STRUCTURES

This is a continuation of application Ser. No. 07/958,631 filed Oct. 9, 1992 which is now abandoned.

TECHNICAL FIELD

The present invention relates to electro-optical addressing structures having multiple address locations arranged in an array and, in particular, to a method and apparatus for reducing the effects of incidental data propagation or crosstalk among the address locations.

BACKGROUND OF THE INVENTION

Electro-optical addressing structures are employed in a variety of applications including video cameras, data storage devices, and flat panel liquid crystal displays. Such addressing structures typically include very large numbers of address locations arranged in an array. For example, a flat panel liquid crystal display configured in accordance with a high-definition television format would typically include at least two million address locations. The address locations would correspond to display elements or pixels that are arranged in about 1000 lines with about 2000 pixels each.

Adjacent pixels in such a display are closely spaced and have incidental capacitive couplings resulting from these small spacings. Such coupling between adjacent pixels will be referred to as "side-to-side" coupling. In addition, during operation of electro-optical addressing structures, the data drive signals for all the pixels in a row or column are typically carried on a common conductor adjacent the pixels. The electrical properties of the electro-optical addressing structures result in capacitive coupling among all the pixels in the column or row. Such coupling among all pixels in a column or row will be referred to as "front-to-back" coupling. These two types of capacitive coupling cause the data drive signal directed to a particular pixel to be carried to other pixels as incidental data signals or crosstalk.

For a display system, the crosstalk is image-dependent, i.e., it depends on the data drive signals present on the conductors and changes the voltage actually stored at a specific pixel. Crosstalk effects include an unpredictable gray scale that limits the number of achievable gray levels below the number necessary for acceptable video performance. A gray level is sensitive to small variations in the means square average voltage ("RMS") across a display element, and the crosstalk changes that voltage. It will be appreciated that gray scale in this context refers to the range of available light output levels in either monochrome or color display systems.

One type of electro-optical addressing structure used in flat panel liquid crystal displays employs an array of thin film transistors to address pixel locations. A driving method that reduces the image dependent crosstalk in such displays, known as Data Complement Drive ("DCD"), is described by Howard et al. in "Eliminating Crosstalk in Thin Film Transistor/Liquid Crystal Displays," International Display Research Conference, 230–35 (1988). DCD entails successively applying a data input signal and its complement to a row of address locations during a row addressing period.

In conventional addressing, a separate data drive signal, $V_i$, is applied to each pixel of a row for a row address period.

DCD entails applying the data drive signal $V_i$ to the pixels for one-half the row address period and then applying a separate data signal complement $\overline{V}_i$ for the remaining one-half of the row address period. The data drive signal complement, $\overline{V}_i$, depends upon the data drive signal $V_i$ and is equal to the difference between a fixed level, $V_m$, and the original data drive signal $V_i$.

DCD does not adequately reduce all types of crosstalk effects in all addressing structures, particularly those having a relatively high susceptibility to crosstalk errors produced by side-to-side coupling. One such addressing structure is described in U.S. Pat. No. 4,896,149 of Buzak et al. for "Addressing Structure Using Ionizable Gaseous Medium", which is assigned to the assignee of the present application. The relatively high susceptibility to crosstalk errors produced by side-to-side coupling is believed to be a consequence of a physical configuration that positions address locations or pixels relatively far from an electrically grounded surface. The relatively large distance to the grounded surface allows the formation of incidental electric fields (i.e., crosstalk) among nearby pixels.

Another drive method for reducing crosstalk is known as the Return to Common Drive ("RTC"). RTC entails applying the data drive signal $V_i$ to the row of pixels for a first phase of the row address period and then applying a common voltage during the remainder of the addressing period. The common voltage is fixed and is independent of the data drive signals-the same common voltage is used for all columns and all lines of the display. This method effectively reduces side-to-side crosstalk, but is less effective in reducing front-to-back crosstalk.

Crosstalk may also be reduced, as described in U.S. patent application Ser. No. 07/854,145, which is assigned to the assignee of the present application, by using a two-phase addressing method in conjunction with a liquid crystal material that is insensitive to the frequency of the two-phase signals. Such frequency sensitive liquid crystals are not, however, suitable for all applications.

SUMMARY OF THE INVENTION

An object of the present invention is, therefore, to provide a method and an apparatus for reducing crosstalk effects in electro-optical addressing structures.

Another object of this invention is to provide such a method and apparatus that are effective with any active matrix electro-optical addressing structures.

A further object of this invention is to simultaneously reduce the effects of front-to-back and side-to-side crosstalk.

The present invention is a method and an apparatus for reducing crosstalk effects in any active matrix type of electro-optical addressing structures employed in, for instance, flat panel display systems. Such a system typically includes an addressing structure for addressing and delivering data drive signals to each of multiple address locations arranged in an array, each address location corresponding to a display element or pixel. Groups of display elements have incidental capacitive couplings that carry noise in the form of incidental data signals or crosstalk.

All display elements in a column of the array are typically connected to one data drive electrode, and all display elements in a row are connected to one data strobe electrode. Information in the form of an analog data drive signal is applied onto each data drive electrode during a row address period. The data drive signal has a voltage of changing magnitude that causes a desired gray level for each display element in the row addressed. A data strobe signal applied to the data strobe electrode for that row activates the data storage. Since only one row receives the data strobe signal, the display elements in other rows, although connected to the same data drive electrodes, do not store the data drive signal.

The present invention, which is referred to as an adaptive drive scheme, uses the voltages from multiple data drive signals to determine a compensating signal that effectively reduces crosstalk. Because the compensating signal is dependent upon the data drive signals, front-to-back crosstalk is more effectively reduced than with RTC. Because the compensating signal depends upon data drive signals from more than one column, side-to-side crosstalk is more effectively reduced than with DCD.

In a preferred embodiment, signals are applied to the data drive electrodes in first and second phases during a row address period. During the first phase, information to be stored by the display element is applied as a data drive signal to the data drive electrode. A data strobe signal is then applied to the data strobe electrode to activate storage of the information. Then, during the second phase, a single compensating signal derived from all the data drive signals previously applied during the first phase is applied to all the data drive electrodes.

The compensating signal has a voltage value equal to the inverse of the average of all the information applied during the first phase as data drive signals multiplied by a weighting factor $\delta/(1-\delta)$ where $\delta$, known as the phase width of the first phase, is the ratio of the duration of the first phase to the duration of row address period. Applying this compensating signal to all data drive electrodes during the second phase reduces both front-to-back and side-to-side crosstalk. When the first and second phases are of equal duration, $\delta=1/2$, the weighting factor $\delta/(1-\delta)=1$, and the compensating signal is simply the inverse of the average of the data drive signals.

The averaging of the data drive signals can be accomplished by using an analog summer circuit, with resistors selected to weight the average for unequal phase widths. During the first phase, the weighted average is calculated by the summer network and buffered. During the second phase, the inverse of the calculated voltage is applied to all the data columns. As an alternative, the weighted average can be determined digitally.

To address the display elements, the addressing structure may employ any of a variety of addressing structures elements including thin film transistors, diodes, an ionizable gaseous medium, metal-insulator-metal, or any other active matrix type. The data strobe electrode would, for example, switch on the gate of a thin film transistor or ionize a gas in a plasma addressed display.

Additional objects and advantages of the present invention will be apparent from the following detailed description of a preferred embodiment thereof, which proceeds with reference to the accompanying drawings.

DETAILED DESCRIPTION OF A PREFERRED EMBODIMENT

Figure 1:
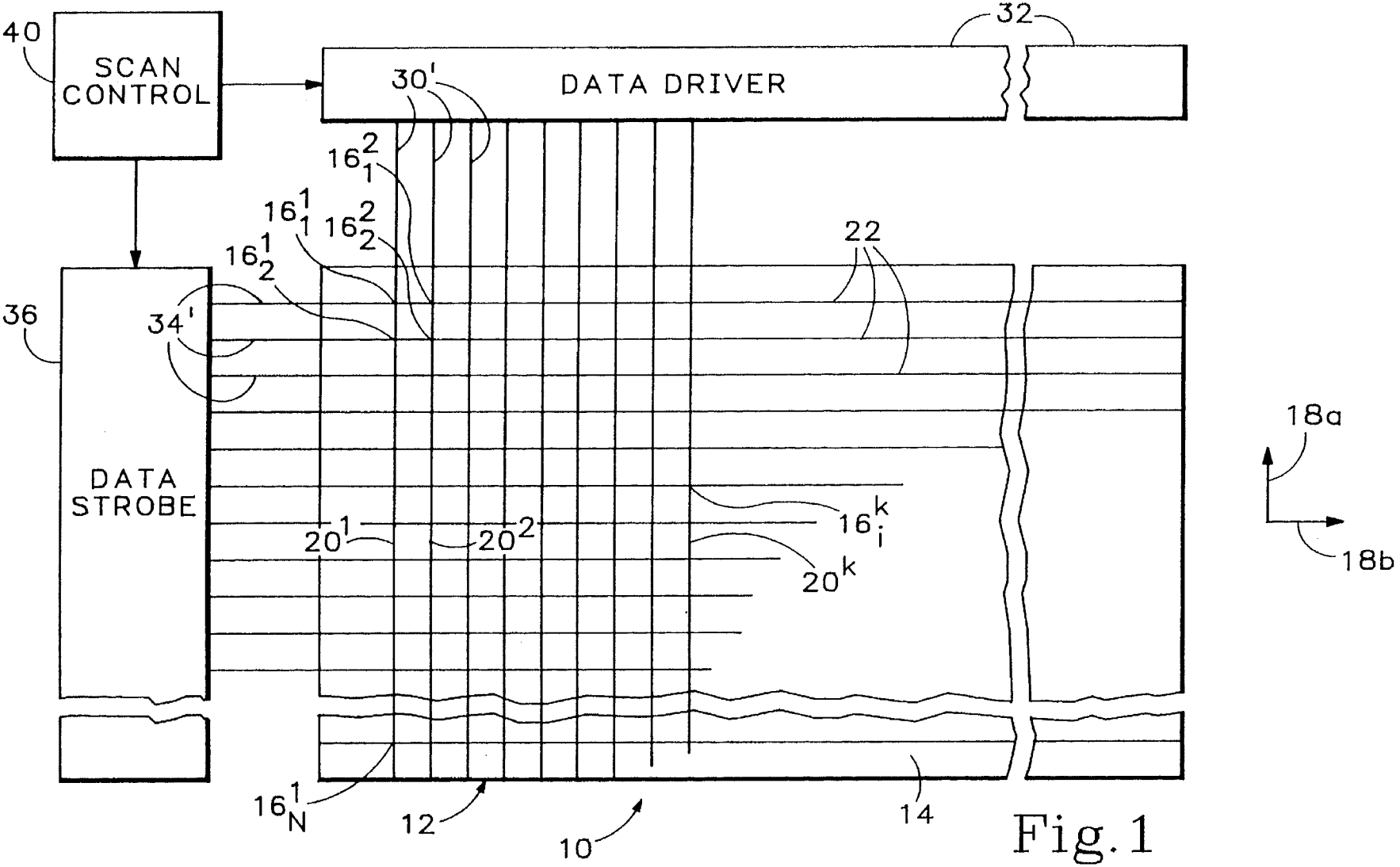
FIG. 1 is a diagram showing a frontal view of the display surface of a display panel and associated drive circuitry of a display system embodying the present invention.

FIG. 1 shows a flat panel display system 10 having a display panel 12 with a display surface 14. A rectangular planar array of nominally identical data storage or display elements 16 are mutually spaced apart by predetermined distances in vertical and horizontal directions 18i a and 18*b*, respectively. The subscript and superscript indicate the respective row and column in which an individual display element $\mathbf{16}^k_1$ is located. To address display elements 16, display panel 12 may employ any of a variety of active matrix addressing structure elements including thin film transistors, metal-insulator-metal, or an ionizable gaseous medium, the last of which is preferred and described below.

Each display element 16 in the array represents the overlapping portions of thin, narrow data drive electrodes 20 arranged in vertical columns and elongate, narrow channels 22 arranged in horizontal rows. (The electrodes 20 are hereinafter referred to as "column electrodes 20" with a superscript when necessary to identify a specific column.) The display elements 16 in each of the rows of channels 22 represent one line of information or data.

Figure 2:
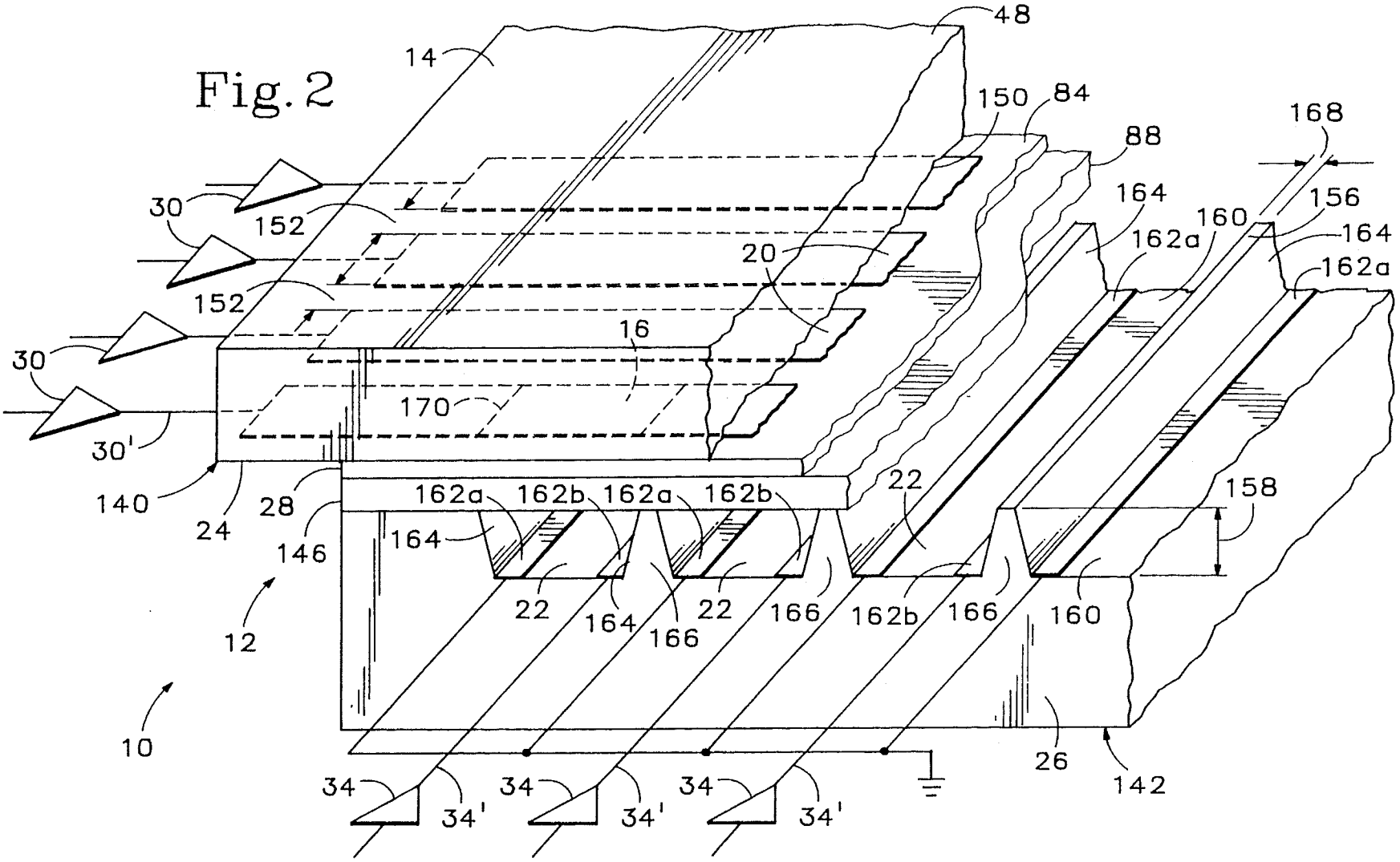
FIG. 2 is an enlarged fragmentary isometric view showing the layers of structural components forming the display panel embodying the present invention as viewed from the left side of FIG. 1.

FIG. 2 shows the layers of structural components forming display panel 12. With reference to FIGS. 1 and 2, the widths of column electrodes 20 and channels 22 determine the dimensions of display elements 16, which are of rectangular shape. Column electrodes 20 are deposited on a major surface of a first electrically nonconductive, optically transparent substrate 24, and channels 22 are inscribed in a major surface of a second electrically nonconductive, optically transparent substrate 26. A layer 28 of frequency-sensitive electro-optical material, such as two-frequency nematic liquid crystal No. ZLI-2461, manufactured by E. Merck, Darmstadt, Frankfurt, Germany, is captured between substrates 24 and 26. Such material is insensitive to high frequency signals and therefore results in diminished crosstalk. However, this invention does not require the use of such frequency dependent liquid crystals to reduce crosstalk. Skilled persons will appreciate that certain systems, such as a reflective display of either the direct view or projection type, would require that only one of the substrates be optically transparent.

Column electrodes 20 receive information in the form of data drive signals and compensating signals, both signals being of the analog voltage type and developed on parallel output conductors 30' by different ones of the output amplifiers 30 of a data driver or data drive means or drive circuit 32. Channels 22 receive data strobe signals of the voltage pulse type developed on parallel output conductors 34' by different ones of the output amplifiers 34 of a data strobe or data strobe means or strobe circuit 36. The data strobe signals cause display elements 16 along the row of channel 22 to store information corresponding to the data drive signals on column electrode 20. To synthesize an image on substantially the entire area of display surface 14, display system 10 employs a scan control circuit 40 that coordinates the functions of data driver 32 and data strobe 36 so that all columns of display elements 16 of display panel 12 are addressed row-by-row in row scan fashion.

In a preferred embodiment, data driver 32 delivers data drive signals and a compensating signal during respective first and second phases of a row addressing period. During the first phase, column electrodes 20 receive information in the form of data drive signals of the analog voltage type and a single channel 22 receives a data strobe signal of the voltage pulse type, causing a voltage related to the data drive signals to be stored by display elements 16 in the row receiving the data strobe signal. During the second phase, all column electrodes 20 receive the same compensating signal, which has a voltage equal to the inverse, i.e. same magnitude but opposite polarity, of the weighted average of all the data drive signals delivered during the first phase.

The weighted average of the data drive signals is computed by summing the data drive signals, dividing by the number of signals, and multiplying $\delta/(1-\delta)$, where $\delta$ is the phase width defined above. If the data drive and the compensating signals have equal durations then $\delta=1/2$, and the value of the compensating signal is equal to the inverse of the average of the data drive signals. A small value of $\delta$ results in more effective compensation of crosstalk, so $\delta$ is preferably as small as practicable. Ultimately, the size of $\delta$ is limited by the time required to set-up and capture the data drive signal.

The value of the compensating signal can be determined using an analog summer circuit with resistors selected to account for unequal phase lengths of the data and compensating signals. During the first phase of the row address period when the data drive signals are applied to electrodes 20, the weighted average of the data drive signals is determined by the summer circuit and stored in a buffer. During the second phase, the inverse of the weighted average of the data drive signals is applied to all column electrodes 20. The weighted averaging could also be performed digitally, with the calculations being performed during the first phase and the inverse of the weighted average being applied during the second phase.

Analog summing typically requires less time than digital calculations, but can suffer from interference effects resulting from the large number of closely spaced conductors. Therefore, the preferred calculation method will depend upon the application parameters, such as the size of the display and the type of addressing structure.

With reference to FIG. 2, display panel 12 includes a pair of generally parallel electrode structures 140 and 142 spaced apart by layer 28 of nematic liquid crystal material. A thin layer 146 of dielectric material, such as glass, mica, or plastic, is positioned between layer 28 and electrode structure 142. Electrode structure 140 includes glass dielectric substrate 24 that has deposited on its inner surface 150 column electrodes 20 of indium tin oxide, which is optically transparent, to form a striped pattern. Adjacent pairs of column electrodes 20 are spaced apart by a distance 152, which defines the horizontal space between next adjacent display elements 16 in a row.

Electrode structure 142 includes glass dielectric substrate 26 into whose inner surface 156 multiple channels 22 of essentially trapezoidal cross section are inscribed. Channels 22 have a depth 158 measured from inner surface 156 to a base portion 160. Each one of the channels 22 has a pair of thin, narrow metal electrodes **162*a* and 162*b* extending along base portion 160 and a pair of inner side walls 164 diverging in the direction away from base portion 160 toward inner surface 156**.

Each of electrodes **162*a*, referred to as reference electrodes 162*a*, is connected to a common electrical reference potential, which can be fixed at ground potential as shown. The electrodes 162*b*, referred to as data strobe electrodes or simply "row electrodes 162*b*," of the channels 22 are connected to different ones of the output amplifiers 34 (of which three are shown in FIG. 2) of data strobe 36**.

The sidewalls 164 between adjacent channels 22 define a plurality of support structures 166 with top surfaces 156 that support layer 146 of dielectric material. Adjacent channels 22 are spaced apart by the width 168 of the top portion of each support structure 166, which width 168 defines the vertical space between next adjacent display elements 16 in a column. The overlapping regions 170 of column electrodes 20 and channels 22 define the dimensions of display elements 16, which are shown in dashed electrodes.

The magnitude of the voltage applied to column electrodes 20 specifies the distance 152 to promote isolation of adjacent column electrodes 20. Distance 152 is typically much less than the width of column electrodes 20. The inclinations of the side walls 164 between adjacent channels 22 specify the distance 168, which is typically much less than the width of channels 22. The widths of the column electrodes 20 and the channels 22 are typically the same and are a function of the desired image resolution, which is specified by the display application. It is desirable to make distances 152 and 168 as small as possible. In current models of display panel 12, the channel depth 158 is one-half the channel width.

Each of channels 22 is filled with an ionizable gas, preferably one that includes helium. Layer 146 of dielectric material functions as an isolating barrier between the ionizable gas contained within channel 22 and layer 28 of liquid crystal material. The absence of dielectric layer 146 would permit either the liquid crystal material to flow into the channel 22 or the ionizable gas to contaminate the liquid crystal material. Dielectric layer 146 may be eliminated from displays that employ a solid or encapsulated electro-optical material, however.

Figure 3:
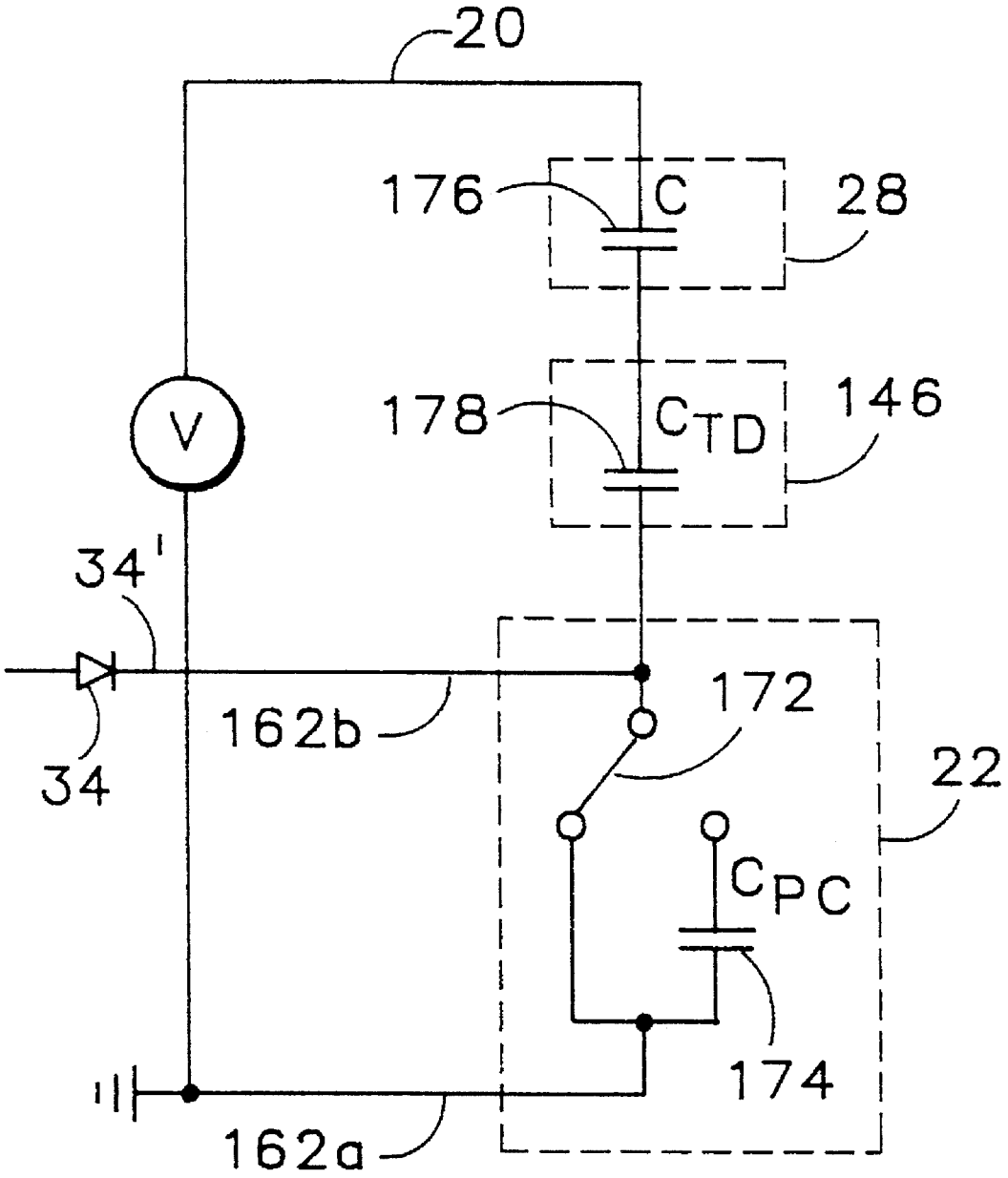
FIG. 3 is an equivalent circuit showing for a display system the operation of the plasma as a switch for an exemplary display element of FIG. 2.

FIG. 3 is an equivalent circuit showing the electrical properties associated with typical structural components of display element 16. The ionizable gas contained within channel 22 operates as an electrical switch 172 whose contact position changes between binary switching states as a function of the voltage applied by data strobe 36 onto row electrode 162b. Switch 172 is connected between dielectric layer 146 and reference electrodes 162a. The absence of a strobe pulse allows the gas within the channels 22 to be in a non-ionized, nonconducting state, thereby causing the ionizable gas to operate as an open switch 172. Channel 22 in its nonconducting OFF state has a capacitance $C_{PC}$ and is represented as a capacitor 174. A strobe pulse applied to row electrode 162*b* is of a magnitude that causes the gas within the channel 22 to be in an ionized, conducting state, thereby causing the ionizable gas to operate as a closed switch.

To store a voltage across the liquid crystal material of layer 28, a data drive signal is applied to electrode 20. When row electrode 162*b* is strobed, the gas contained within channel 22 beneath electrode structure 140 is ionized and provides an electrically conductive path from dielectric layer 146 to reference electrode 162*a*, which is typically grounded. Thus, the data drive signal is sampled by the dielectric layer 146 and liquid crystal layer 28, which are represented by capacitors 176 and 178 in series. Extinguishing the plasma acts to remove the conductive path to ground by opening switch 172 and to place the OFF state capacitance $C_{PC}$ of channel 22, represented by capacitor 174, into the circuit, thereby allowing the sampled voltage to be stored across display element 16.

The voltage across liquid crystal layer 28 changes somewhat as the properties of plasma channel 22 switches from those of a conductive to those of a capacitive element. The actual voltage stored across the liquid crystal itself is thus a function of the data drive signal and the capacitances of the liquid crystal layer 28, dielectric layer 146, and the plasma channel 22 in the OFF state. The voltages remain stored across layer 28 of the liquid crystal material with negligible decrease resulting from leakage current until voltages representing a new line of data in a subsequent image field are developed across the layer 28. The above-described addressing structure and technique provide signals of essentially 100% duty cycle to every one of the display elements 16.

Figure 4A:
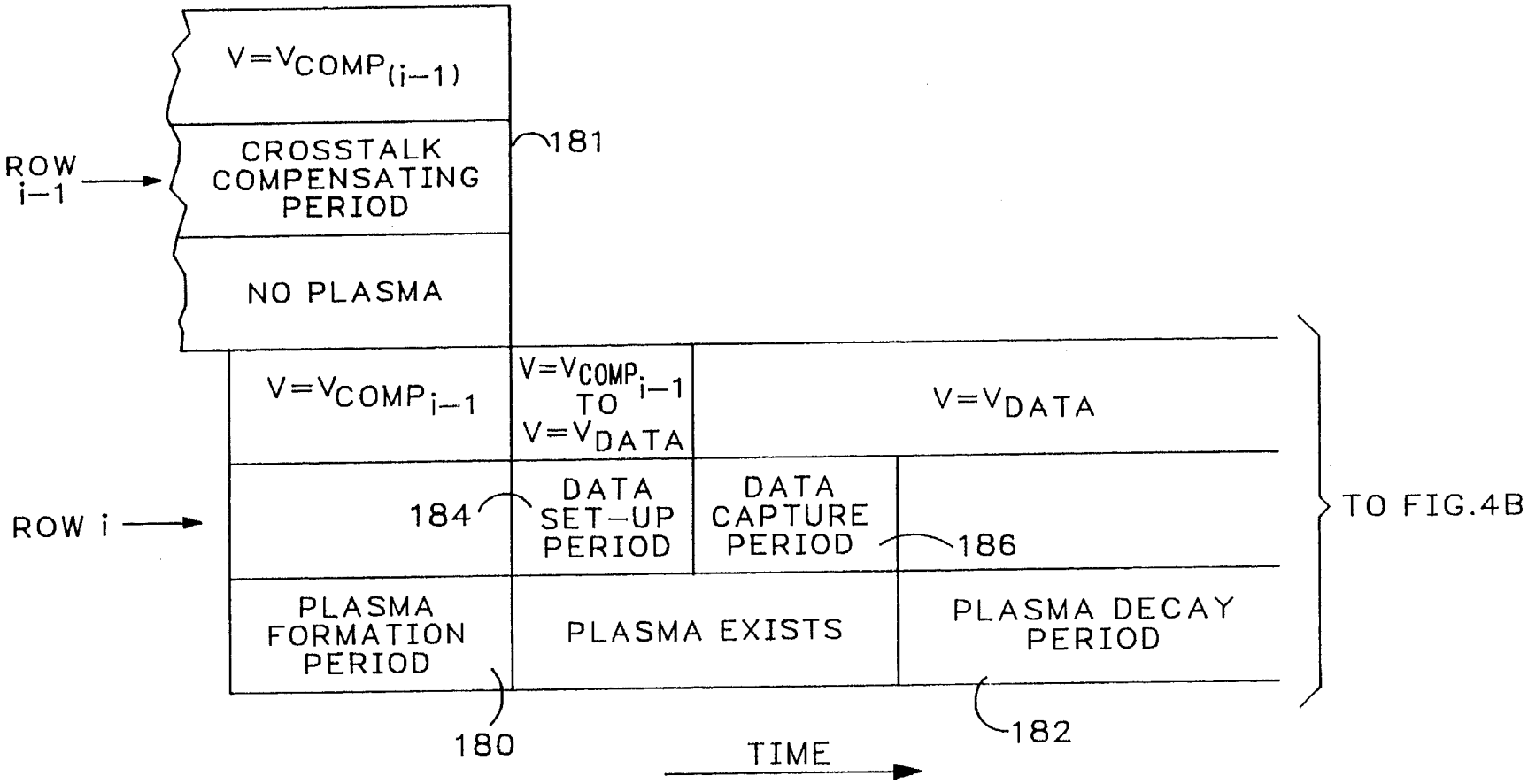
FIG. 4 is a diagram showing the various time constraints that determine the maximum number of lines of data that are addressable by a plasma addressed display embodying the present invention.
Figure 4B:
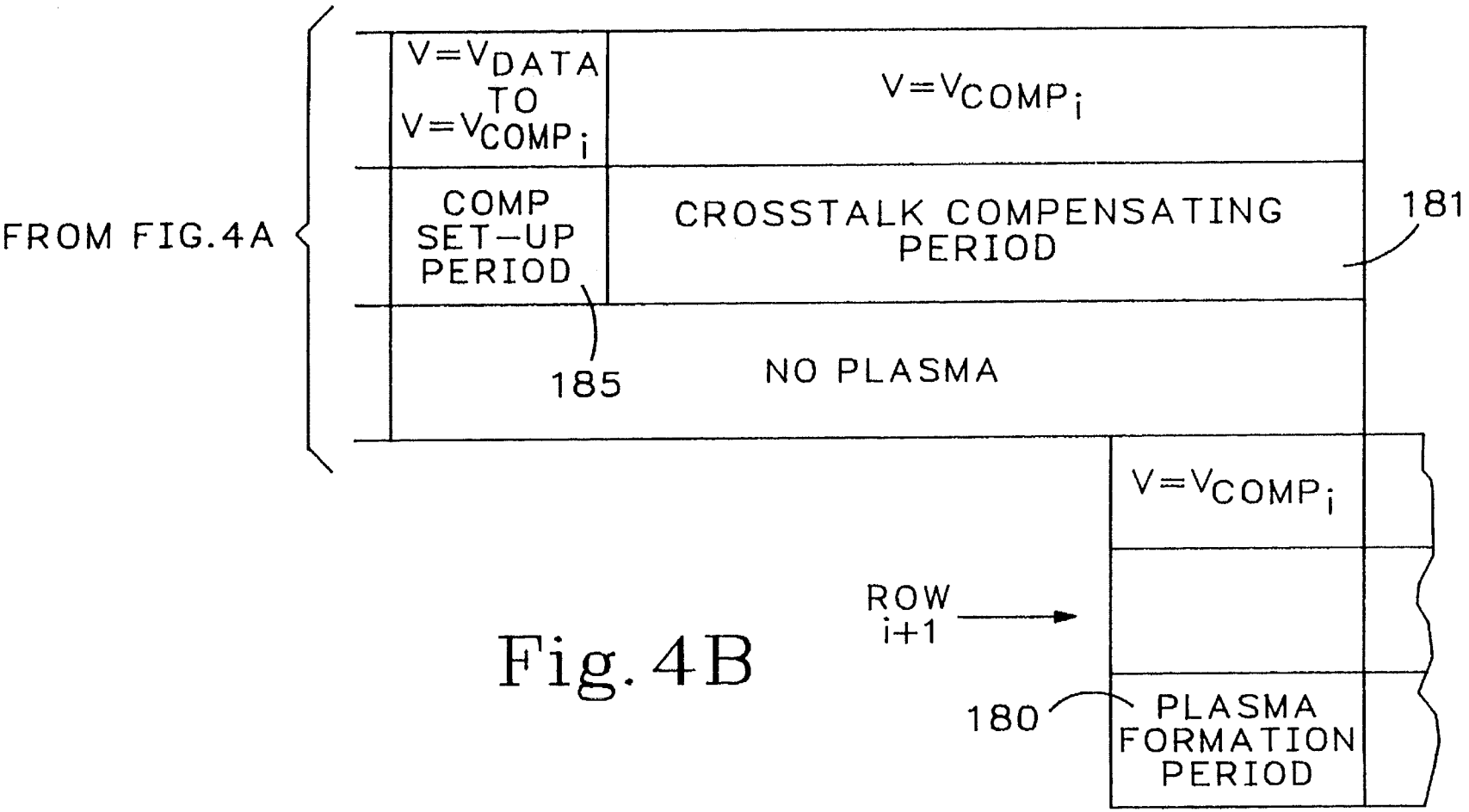

FIG. 4 is a diagram showing the various time constraints during a complete addressing period of an exemplary row i in display system 10 and part of the addressing period for a previous row i−1 and subsequent row i+1. The representation of the addressing period of each row is divided horizontally into three segments: the bottom segment shows the state of the plasma in channel 22, the top segment shows the voltage applied to column electrode 20, and the center segment labels the various time periods.

The exemplary row requires a plasma formation period 180 for the plasma to form after the row electrode 162*b* of the strobed channel 22 receives a strobe pulse. In the preferred embodiment, the plasma formation period 180 for helium gas is nominally a few microseconds. The plasma formation period 180 begins by initiating the strobe pulse during the application of the compensating signal during a crosstalk compensating period 181 for the preceding row. The plasma decay period 182 represents the time during which the plasma in channel 22 returns to a nonionized state upon the removal of a strobe pulse from row electrode 162*b*.

A data setup period 184 represents the time during which data driver 32 slews between the compensating signal values for the previous line and the data drive signal values of the currently strobed line and develops on output amplifiers 30 the analog data drive voltage signals that are applied to column electrodes 20. Compensating setup period 185 is similar to data setup period 184, but the data is slewing between the data drive values and the compensating values for the current line. Setup periods 184 and 185 are functions of the electronic circuitry used to implement data driver 32. A data setup period 184 of less than 1.0 microsecond is achievable.

The data capture period 186 depends on the conductivity of the ionizable gas contained within channels 22. Preferred values of operating parameters, such as gas pressure and electrical current, are those that provide the fastest data capture time 186 for positive ion current from the anode (reference electrode 162*a*) to the cathode (row electrode 162*b*). Such values will depend upon the size and shape of channels 22.

The voltage stored across liquid crystal layer 28 when the plasma is extinguished and subsequent crosstalk determine the RMS voltage across layer 28. The RMS voltage across layer 28 determines the orientation of the liquid crystal molecules, which in turn determines the optical transmission properties of layer 28 and the gray level of display element 16. The voltage required for a desired gray level can be stored across liquid crystal layer 28 during the row addressing period by providing an appropriate data drive signal, since the capacitances of the liquid crystal layer 28, dielectric layer 146, and the plasma channel 22 in the OFF state are fixed and known.

The crosstalk depends, however, not only upon the fixed capacitive coupling among display elements 16 and data drive electrodes 20, but also upon data drive signals applied to electrodes 20 during subsequent row addressing periods. Because the values of subsequent data drive signals are unknown during the address period of a particular row, the effect of crosstalk on the RMS voltage across liquid crystal layer 28 cannot be fully determined and compensated for at that time.

Figure 5:
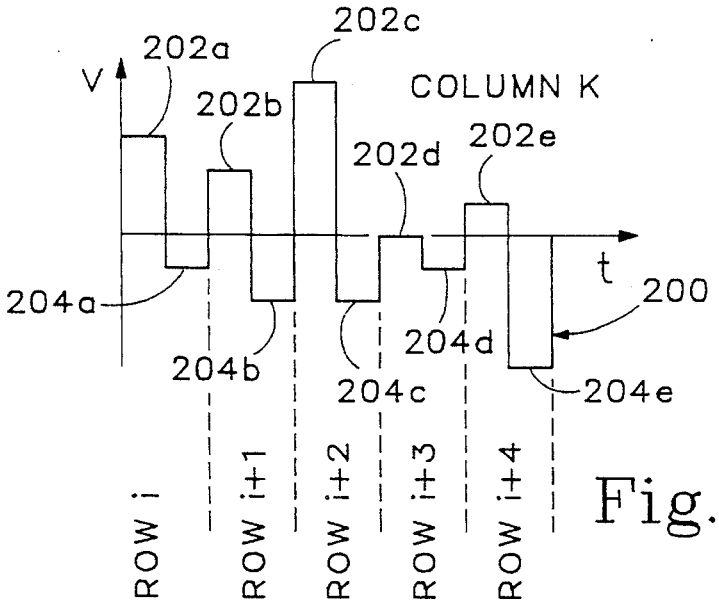
FIGS. 5 and 6 show exemplary voltages applied to respective column k and k+1 during the addressing periods of row i to i+4.
Figure 6:
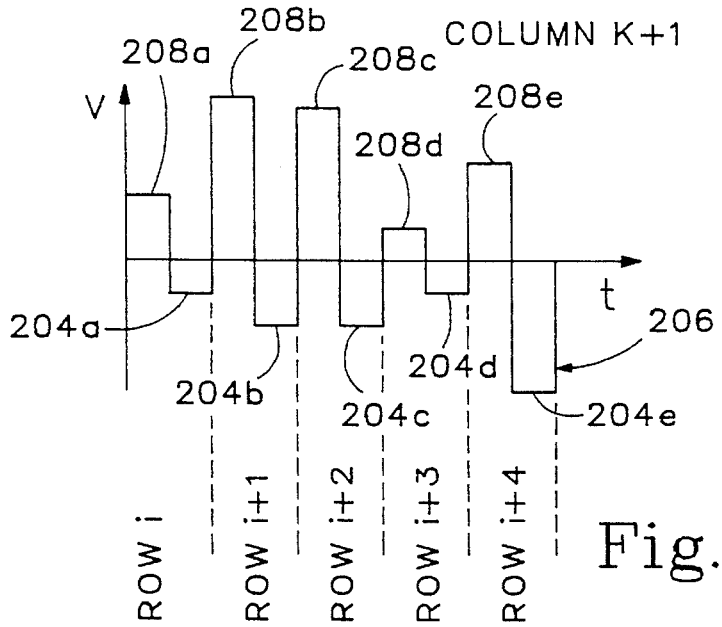

FIG. 5 is a simplified voltage diagram 200 showing exemplary data drive signals 202*a*–202*e* and corresponding compensating signals 204*a*–204*e* applied to display elements $\mathbf{16}^k_i$, $\mathbf{16}^k_{i+1}$, . . . $\mathbf{16}^k_{i+4}$ arranged along column electrode $\mathbf{20}^k$ of display panel 12. Similarly, FIG. 6 is a schematic timing diagram 206 showing exemplary data drive signals 208*a*–208*e* and corresponding compensating signals 204*a* through 204*e* applied to display elements $\mathbf{16}^{k+1}_i$, $\mathbf{16}^{k+1}_{i+1}$, . . . $\mathbf{16}^{k+1}_{i+4}$ arranged along column electrode $\mathbf{20}^{k+1}$. The display element addressed during the application of voltage 202*a* and the display element addressed during the application of voltage 208*a* are in respective columns k and k+1 and both are in row i. Voltages 202*b* and 208*b* are addressed to elements in row i+1, voltages 202*c* and 208*c* are addressed to elements in row i+2, . . . and voltages 202*e* and 208*e* are addressed to elements in row i+4. It can be seen from FIGS. 5 and 6 that the data drive signals 202*a*–202*e* are different from data drive signals 208*a*–208*e*, but that the same compensating signals 204*a*–204*e* are used on both column electrodes 20k and 20k+1.

Figure 7:
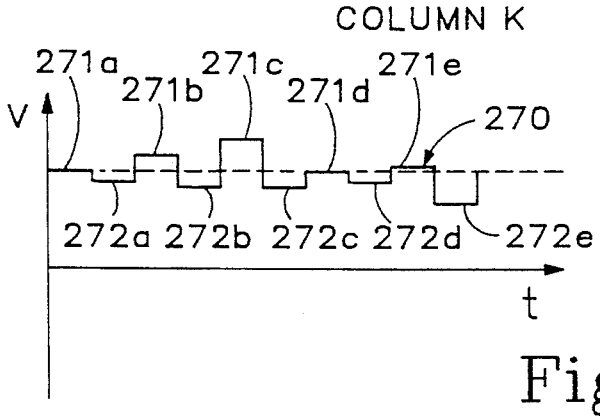
FIG. 7 shows the varying voltage across a single display element in column k and row i during the row address period of rows i to i+4, the varying voltage resulting from crosstalk and the voltages shown in FIG. 5 applied to the electrode of column k.

FIG. 7 is a simplified diagram 70 showing exemplary voltages across display element $\mathbf{16}^k_i$, which was addressed by data drive signal 202*a* shown in FIG. 5. Voltage 271*a* represents the voltage across the liquid crystal portion of display element $\mathbf{16}^k_i$ during its row address period.

Because the light transmission through display element 16 responds to the RMS voltage across liquid crystal layer 28, it is desirable that the RMS voltage maintain a nominal value to provide a desirable gray level. Voltage 271*a* applied across display element $\mathbf{16}^k_i$ during the ith row address period is such that when plasma channel 22 is in the OFF state, the desired nominal voltage is stored across liquid crystal layer 28. However, voltages 271*b* through 271*e*, i.e., the voltages across display element 16 during the first phase of the i+1 through i+4 row addressing periods, vary from the desired nominal value because of front-to-back crosstalk from data drive voltage 202*a* through 202*e* applied in column K and because of side-to-side crosstalk from data drive signals, such as 208*a* through 208*e*, applied to adjacent columns k−1 and k+1.

Voltages 272*a*–272*e* represent the voltages across liquid crystal layer 28 at display element 16 during the application of the preferred compensating signal in the second phase of the respective i through i+4 row address period. The voltages 272*a*–272*e* compensate for the deviation of voltages 271*b*–271*e* from the desired nominal voltage so the RMS voltage across display element 16 is approximately the desired nominal voltage.

To derive and evaluate a preferred crosstalk compensation drive method, the RMS voltage across liquid crystal layer 28 at display element $\mathbf{16}^k_i$ can be described by an equation, and the equation can then be used to evaluate crosstalk compensating schemes.

The RMS voltage during a frame address period across display element $\mathbf{16}^k_i$ driven by a single phase addressing method can be expressed as:

$$\langle V^2\rangle_i^k = \frac{1}{N}\left(\frac{V_i^k}{C\alpha}\right)^2 + \frac{1}{N}\sum_{j=1}^{i-1}\left(\frac{V_i^k}{C}\left(\frac{1}{\alpha}-\frac{1}{\beta}\right) - \frac{V_j^k}{C\beta} - \frac{V_j^{k+1}+V_j^{k-1}-2V_j^k}{D}\right)^2 + \frac{1}{N}\sum_{j=i+1}^{N}\left(\frac{V_i^k}{C}\left(\frac{1}{\alpha}-\frac{1}{\beta}\right) + \frac{V_j^k}{C\beta} + \frac{V_j^{k+1}-V_j^{k-1}-2V_j^k}{D}\right)^2 \quad (1)$$

in which $\langle V^2\rangle^k_i$ represents the RMS voltage across the display element in row i and column k.

N is the number of row address periods in a frame address period.

$V^k_i$ is the voltage applied to the kth column during the ith addressing period. $V^k_i$ typically has values 0–60 V in a plasma addressed display and between 0 and a few volts for a thin film transistor ("TFT") device.

C is the normalized capacitance of a liquid crystal layer.

$\alpha \equiv 1/C + 1/C_{TD}$ where $C_{TD}$ is the capacitance of dielectric layer 146. The parameter α indicates that the data drive voltage is divided between liquid crystal layer 28 and dielectric layer 146 and has a value of approximately 7 to 9 in a plasma addressed display. In a TFT display, there is no dielectric layer 146 and, therefore, α=1.

$\beta \equiv 1/C + 1/C_{TD} + 1/C_{PC}$ where $C_{PC}$ is the capacitance of plasma channel 22 in the OFF state. The parameter β indicates that the voltage across liquid crystal layer 28 changes when the plasma in channel 22 is extinguished. The parameter β has a value of approximately 100 in a plasma addressed display and is equivalent to the source-to-drain capacitance in a TFT display element.

D is an empirically derived term describing the capacitive couplings between the display element and the adjacent bus lines and has a value of about 100 in the plasma addressed display described above.

The first term of equation (1) represents the contribution to the RMS voltage across liquid crystal layer 28 of display element $\mathbf{16}^k_i$ from the data drive voltage addressing that element. The second term represents the contributions of the drive voltages addressed to rows 1 to i−1, and the third term represents the contributions of the data drive voltages addressed to rows i+1 to N.

Regarding the second and third terms, the first term inside each summation expression represents the contribution to the RMS voltage from the charge that was stored in the display during the addressing of the ith addressing period and that redistributes itself as a consequence of the capacitance of the plasma channel when it is in the OFF state. The second term inside each summation expression represents the contribution to the RMS voltage that results from front-to-back crosstalk, i.e., the incidental effects resulting from drive voltages applied to column electrode 20k during row address periods other than the ith row address period. Such incidental effects are determined by the capacitances of liquid crystal layer 28, dielectric layer 146, and the plasma channel 22. The last term within each summation expression describes the side-to-side crosstalk, i.e., the effect of data drive voltages on the k+1 and k−1 adjacent columns on the RMS voltage across a pixel in the kth column.

Addressing schemes, such as the adaptive drive scheme of the preferred embodiment of the current invention, DCD, or RTC, are two phase drive schemes. A first voltage is applied to column electrode 20 during a first phase of phase width δ and a second voltage, W, is applied to column electrode 20 during a second phase of phase width 1−δ. The equation describing the RMS voltage across a display element driven by such a drive is similar to the equation 1 but with a set of additional, analogous terms describing the second phase of the drive:

$$\langle V^2\rangle_i^k = \delta\left\{\frac{1}{N}\left(\frac{V_i^k}{C\alpha}\right)^2 + \frac{1}{N}\sum_{j=1}^{i-1}\left(\frac{V_i^k}{C}\left(\frac{1}{\alpha}-\frac{1}{\beta}\right) - \frac{V_j^k}{C\beta} - \frac{V_j^{k+1}+V_j^{k-1}-2V_j^k}{D}\right)^2 + \frac{1}{N}\sum_{j=i+1}^{N}\left(\frac{V_i^k}{C}\left(\frac{1}{\alpha}-\frac{1}{\beta}\right) + \frac{V_j^k}{C\beta} + \frac{V_j^{k+1}+V_j^{k-1}-2V_j^k}{D}\right)^2\right\} + \{1-\delta\}\left\{\frac{1}{N}\left(\frac{V_i^k}{C}\left(\frac{1}{\alpha}-\frac{1}{\beta}\right) + \frac{W_i^k}{C\beta} + \frac{W_i^{k+1}+W_i^{k-1}-2W_i^k}{D}\right)^2 + \frac{1}{N}\sum_{j=1}^{i-1}\left(\frac{V_i^k}{C}\left(\frac{1}{\alpha}-\frac{1}{\beta}\right) - \frac{W_j^k}{C\beta} - \frac{W_j^{k+1}-W_j^{k-1}-2W_j^k}{D}\right)^2 + \quad (2)$$

-continued $$\frac{1}{N}\sum_{j=i+1}^{N}\left(\frac{V_i^k}{C}\left(\frac{1}{\alpha}-\frac{1}{\beta}\right)+\frac{W_j^k}{C\beta}+\frac{W_j^{k+1}+W_j^{k-1}-2W_j^k}{D}\right)^2\Bigg\}$$

in which $W^k_i$ is the voltage applied to column electrode 20$^k$ during the second phase of the addressing period of the ith row. The effect of the change in voltage across the display element 16$^k_i$ that results from the redistribution of charge in the OFF-state of channel 22 can be compensated by multiplying all data drive voltages by $\beta/(\beta-\alpha)$, which simplifies the RMS voltage to:

$$\langle V^2\rangle_i^k=\delta\Bigg\{\frac{1}{N}\left(\frac{V_i^k}{C\alpha}+\frac{V_i^k}{C(\beta-\alpha)}\right)^2+\frac{1}{N}\sum_{j=1}^{i-1}\left(\frac{V_i^k}{C\alpha}-\frac{V_j^k}{C(\beta-\alpha)}-\frac{V_j^{k+1}+V_j^{k-1}-2V_j^k}{D(\beta-\alpha)/\beta}\right)^2+\frac{1}{N}\sum_{j=i+1}^{N}\left(\frac{V_i^k}{C\alpha}+\frac{V_j^k}{C(\beta-\alpha)}+\frac{V_j^{k+1}+V_j^{k-1}-2V_j^k}{D(\beta-\alpha)/\beta}\right)^2\Bigg\}+\{1-\delta\}\frac{1}{N}\left(\frac{V_i^k}{C\alpha}+\frac{W_i^k}{C(\beta-\alpha)}+\frac{W_i^{k+1}+W_i^{k-1}-2W_i^k}{D(\beta-\alpha)/\beta}\right)^2+\frac{1}{N}\sum_{j=1}^{i-1}\left(\frac{V_i^k}{C\alpha}-\frac{W_j^k}{C(\beta-\alpha)}-\frac{W_j^{k+1}+W_j^{k-1}-2W_j^k}{D(\beta-\alpha)/\beta}\right)^2+\frac{1}{N}\sum_{j=i+1}^{N}\left(\frac{V_i^k}{C\alpha}+\frac{W_j^k}{C(\beta-\alpha)}+\frac{W_j^{k+1}+W_j^{k-1}-2W_j^k}{D(B-\alpha)/\beta}\right)^2\Bigg\} \tag{3}$$

Because $\beta/(\beta-\alpha)$ is small, changes induced in $\alpha$ and $\beta$ by this correction are neglected.

The difference between the actual and the desired RMS voltage across liquid crystal layer 18 is called the RMS voltage error and is expressed mathematically as:

$$\langle V^2_{error}\rangle_i^k=\langle V^2\rangle_i^k-\left(\frac{V_i^k}{C\alpha}\right)^2 \tag{4}$$

Substituting the expression for $\langle V^2\rangle^k_i$ from equation (3) into equation (4) yields a comprehensive expression describing the RMS voltage error in the display element:

$$\langle V^2_{error}\rangle_i^k=\frac{\delta}{N}\left(\overset{\boxed{3}}{\frac{2(V_i^kV_i^k)}{C^2\alpha(\beta-\alpha)}}+\overset{\boxed{4}}{\frac{(V_i^k)^2}{(C(\beta-\alpha))^2}}\right)+\frac{1-\delta}{N}\left(\overset{\boxed{3}}{\frac{2(V_i^kW_i^k)}{C^2\alpha(\beta-\alpha)}}+\overset{\boxed{4}}{\frac{(W_i^k)^2}{(C(\beta-\alpha))^2}}\right)+\frac{1-\delta}{N}\left(\overset{\boxed{2}}{\frac{2V_i^k(W_i^{k+1}+W_i^{k-1}-2W_i^k)}{C\alpha D(\beta-\alpha)/\beta}}+\overset{\boxed{3}}{\frac{2W_i^k(W_i^{k+1}+W_i^{k-1}-2W_i^k)}{CD(\beta-\alpha)^2/\beta}}+\overset{\boxed{2}}{\left(\frac{W_i^{k+1}+W_i^{k-1}-2W_i^k}{D(\beta-\alpha)/\beta}\right)^2}\right)+\frac{1}{N}\sum_{j=1}^{i-1}\Bigg[\overset{\boxed{2}}{\frac{\delta(V_j^{k+1}+V_j^{k-1}-2V_j^k)^2+(1-\delta)(W_j^{k+1}+W_j^{k-1}+W_j^{k-1}-2W_j^k)^2}{(D(\beta-\alpha)/\beta)^2}}-\overset{\boxed{2}}{\frac{2V_i^k(\delta(V_j^{k+1}+V_j^{k-1}-2V_j^k)+(1-\delta)(W_j^{k+1}+W_j^{k-1}-2W_j^k))}{C\alpha D(\beta-\alpha)/\beta}}+\overset{\boxed{3}}{\frac{2[\delta V_j^k(V_j^{k+1}+V_j^{k-1}-2V_j^k)+(1-\delta)W_j^k(W_j^{k+1}+W_j^{k-1}-2W_j^k)]}{CD(\beta-\alpha)^2/\beta}}-\overset{\boxed{3}}{\frac{2V_i^k(\delta V_j^k+(1-\delta)W_j^k)}{C^2\alpha(\beta-\alpha)}}+\overset{\boxed{4}}{\frac{\delta(V_j^k)^2+(1-\delta)(W_j^k)^2}{(C(\beta-\alpha))^2}}\Bigg]+ \tag{5}$$

-continued $$\frac{1}{N}\sum_{j-i+1}^{N}\left[\frac{\overset{\boxed{2}}{\delta(V_j^{k+1}+V_j^{k-1}-2V_j^k)^2+(1-\delta)(W_j^{k+1}+W_j^{k-1}-2W_j^k)^2}}{(D(\beta-\alpha)/\beta)^2}+\right.$$

$$\frac{\overset{\boxed{2}}{2V_i^k(\delta(V_j^{k+1}+V_j^{k-1}-2V_j^k)+(1-\delta)(W_j^{k+1}+W_j^{k-1}-2W_j^k))}}{C\alpha D(\beta-\alpha)/\beta}+$$

$$\frac{\overset{\boxed{3}}{2[\delta V_j^k(V_j^{k+1}+V_j^{k-1}-2V_j^k)+(1-\delta)W_j^k(W_j^{k+1}+W_j^{k-1}-2W_j^k)]}}{CD(\beta-\alpha)^2/\beta}+\frac{\overset{\boxed{3}}{2V_i^k(\delta V_j^k+(1-\delta)W_j^k)}}{C^2\alpha(\beta-\alpha)}+\left.\frac{\overset{\boxed{4}}{\delta(V_j^k)^2+(1-\delta)(W_j^k)^2}}{(C(\beta-\alpha))^2}\right]$$

The relative magnitude, or order, of each term is indicated in a box above the term; terms of a lower order are more significant than terms of a higher order, with each unit decrease in order representing approximately a ten-fold increase in magnitude. The relative order of the terms C, α, D, and β are, respectively, 0, 1, 1, 2.

Error equation (5) includes terms attributable to front-to-back crosstalk, side-to-side crosstalk, and dielectric and plasma channel capacitances. The side-to-side crosstalk terms include voltages having superscripts of k+1 or k−1, indicating that the voltages are on column electrodes 20 other than but adjacent to column electrode 20 which addresses display element $\mathbf{16}^k_i$ being analyzed The front-to-back crosstalk terms contain voltages having superscript k and subscript j≠i, indicating that the voltages are addressed to display elements 16 of column k but located in rows other than the ith row. Terms containing voltages having a subscript of i and a superscript of k are not crosstalk terms. Such terms relate to the effect of the addressing structure on the voltage stored in the display element during its row addressing period.

The value of terms within the summation expressions cannot be determined and compensated exactly during the addressing of row i because the data drive voltage values for subsequent row address periods are not known at that time. Therefore, a goal of the two-phase addressing scheme of this invention is to choose values for the compensation voltage (W terms) that result in the algebraic cancellation of as many low order RMS voltage error terms as possible within the summation expression.

The effectiveness of a crosstalk reduction drive scheme for an active matrix display can be determined by substituting the chosen values of the W terms into equation (5). In the adaptive drive scheme of the present invention voltage $\overline{W}$ defined as $$\overline{W}\equiv\frac{-\delta}{(1-\delta)M}\sum_{k=1}^{M}V_j^k$$

is applied to all column electrodes 20 during the second phase of the addressing period for the ith row. Substituting $\overline{W}$ for $W^k_i$, $W^{k+1}_i$, and $W^{k+1}_i$ into equation (5) and simplifying the equation yields:

$$\text{Adaptive Drive } \langle V_{error}^2\rangle_i^k=\frac{1}{N}\left[\sum_{j=1}^{N}\left[\frac{\overset{\boxed{2}}{\delta[\Delta V_j^k]^2}}{[D[\beta-\alpha]/\beta]^2}-\frac{\overset{\boxed{3}}{2\delta V_j^k\Delta V_j^k}}{CD[\beta-\alpha]^2/\beta}+\frac{\overset{\boxed{4}}{\delta[V_j^k]^2+[1-\delta]\,[\overline{W}_j]^2}}{[C[\beta-\alpha]]^2}\right]\right]-\tag{7}$$

$$\frac{\overset{\boxed{2}}{\delta[\Delta V_i^k]^2}}{N[D[\beta-\alpha]/\beta]^2}-\frac{\overset{\boxed{3}}{2\delta V_i^k\Delta V_i^k}}{NCD[\beta-\alpha]^2/\beta}+\frac{\overset{\boxed{4}}{2V_i^k[\delta V_i^k+[1-\delta]\overline{W}_i]}}{NC^2\alpha[\beta-\alpha]}+$$

$$\frac{2V_i^k}{N}\left[-\sum_{j=1}^{i-1}\left[\frac{\overset{\boxed{2}}{\delta\Delta V_j^k}}{C\alpha D[\beta-\alpha]/\beta}+\frac{\overset{\boxed{3}}{\delta V_j^k+[1-\delta]\overline{W}_j}}{C^2\alpha[\beta-\alpha]}\right]+\sum_{j=i+1}^{N}\left[\frac{\overset{\boxed{2}}{\delta\Delta V_j^k}}{C\alpha D[\beta-\alpha]/\beta}+\frac{\overset{\boxed{3}}{\delta V_j^k+[1-\delta]\overline{W}_j}}{C^2\alpha[\beta-\alpha]}\right]\right]$$

in which $\Delta V_i^k\equiv(V_i^{k+1}+V_i^{k-1}-2V_i^k)$.

Similarly, substituting $W^k_j=W_m-V^k_j$, which describes the second phase compensating voltage of DCD into equation (5), yields an error equation for DCD, using phases of equal length (δ=½), of:

$$DCD\langle V_{error}^2\rangle_i^k=\left(\frac{N+2-2i}{N}\right)\left(\frac{\overset{\boxed{3}}{2(V_i^kW_m)}}{C^2\alpha(\beta-\alpha)}\right)+\tag{8}$$

$$\frac{\overset{\boxed{3}}{2V_i^k(V_i^{k+1}+V_i^{k-1}-2V_i^k)}}{N\,CD(\beta-\alpha)^2/\beta}+$$

$$\frac{1}{2N}\sum_{j=1}^{N}\frac{\overset{\boxed{2}}{2(V_j^{k+1}+V_j^{k-1}-2V_j^k)^2}}{(D(\beta-\alpha)/\beta)^2}-$$

$$\frac{\overset{\boxed{3}}{2W_m(V_j^{k+1}+V_j^{k-1}-2V_j^k)}}{CD(\beta-\alpha)^2/\beta}+\frac{\overset{\boxed{4}}{(V_j^k)^2+(W_m-V_j^k)^2}}{(C(\beta-\alpha))^2}$$

For RTC, which apples a fixed compensating voltage $W_c$ during a second phase of arbitrary length, the resulting error is:

$$RTC\langle V^2_{error}\rangle_i^k = \frac{1}{N}\left[\sum_{j-l}^{N}\left(\overset{\boxed{2}}{\frac{\delta(\Delta V_j^k)^2}{(D(\beta-\alpha)/\beta)^2}} - \overset{\boxed{3}}{\frac{2\delta V_j^k \Delta V_j^k}{CD(\beta-\alpha)^2/\beta}} + \overset{\boxed{4}}{\frac{\delta(V_j^k)^2 + (1-\delta)(W_c)^2}{(C(\beta-\alpha))^2}}\right) - \overset{\boxed{2}}{\frac{\delta(\Delta V_i^k)^2}{(D(\beta-\alpha)/\beta)^2}} - \overset{\boxed{3}}{\frac{2\delta V_i^k \Delta V_i^k}{CD(\beta-\alpha)^2/\beta}}\right] + \frac{2V_i^k}{N}\left[-\sum_{j=1}^{i-1}\left(\overset{\boxed{2}}{\frac{\delta\Delta V_j^k}{C\alpha D(\beta-\alpha)/\beta}} + \overset{\boxed{3}}{\frac{\delta V_j^k + (1-\delta)W_c}{C^2\alpha(\beta-\alpha)}}\right) + \sum_{j=i+1}^{N}\left(\overset{\boxed{2}}{\frac{\delta\Delta V_j^k}{C\alpha D(\beta-\alpha)/\beta}} + \overset{\boxed{3}}{\frac{\delta V_j^k + (1-\delta)W_c}{C^2\alpha(\beta-\alpha)}}\right) + \overset{\boxed{3}}{\frac{\delta V_i^k + (1-\delta)W_c}{C^2\alpha(\beta-\alpha)}}\right] \quad (9)$$

Terms in error equations (7), (8), and (9) that contain $\Delta V^k_j$ stem from side-to-side crosstalk. Terms which contain $V^k_j$ stem from front-to-back crosstalk and terms which contain both $\Delta V^k_j$ and $V^k_j$ are cross terms which stem from both types of crosstalk.

The relative effectiveness of the three crosstalk reduction methods can be compared by comparing the terms of equations (7), (8), and (9). The largest error terms in equation (7) (adaptive drive scheme) are second order terms, all of which represent side-to-side crosstalk. These terms are identical to the second order terms of equation (9) (RTC), indicating that both methods reduce side-to-side crosstalk by approximately the same amount.

Comparing side-to-side crosstalk reduction of adaptive drive with that of DCD is more difficult because the terms of equation 7 (adaptive drive) do not correspond to those of equation (8) (DCD). One way to obtain terms that are comparable is to consider the crosstalk resulting from the worst-case image, i.e. one having alternating vertical stripes. In such a case, equation (8), representing the voltage error of DCD, can be reduced to:

$$DCD\langle V^2_{error}\rangle_i^k = \overset{\boxed{2}}{\frac{-2V_i^k\Delta V_i^k(1-\delta)}{NC\alpha D(\beta-\alpha)/\beta}} + \frac{\overset{\boxed{2}}{\left[-\delta(\Delta V_i^k)^2 + \sum_{j=1}^{N}\left(\frac{\delta}{1-\delta}\right)(\Delta V_j^k)^2\right]}}{ND(\beta-\alpha)/\beta^2} \quad (10)$$

and equation (7), representing the voltage error of the adaptive drive scheme, can be reduced to:

$$\text{Adaptive Drive } \langle V^{2error}\rangle_i^k = \frac{\delta\left[-(\Delta V_i^k)^2 + \sum_{j=1}^{N}(\Delta V_j^k)^2\right]}{N(D(\beta-\alpha)/\beta)^2} + \quad (11)$$

-continued $$\overset{\boxed{2}}{\frac{2\delta V_i^k}{NC\alpha D(\beta-\alpha)/\beta}}\left[\begin{array}{l} -\sum_{j=1}^{i-1}\Delta V_j^k \\ +\sum_{j=i+1}^{N}\Delta V_j^k \end{array}\right]$$

For pixels at which $V^k_i$ is sufficiently small the second term in equation (11) is negligible and adaptive drive is shown to be superior to DCD in side-to-side cross-talk errors by a factor $1/(1-\delta)$. However, when $V^k_i$ is not small the second term cannot be ignored and because it is image dependent, it cannot be calculated for a general case.

Figure 8A:
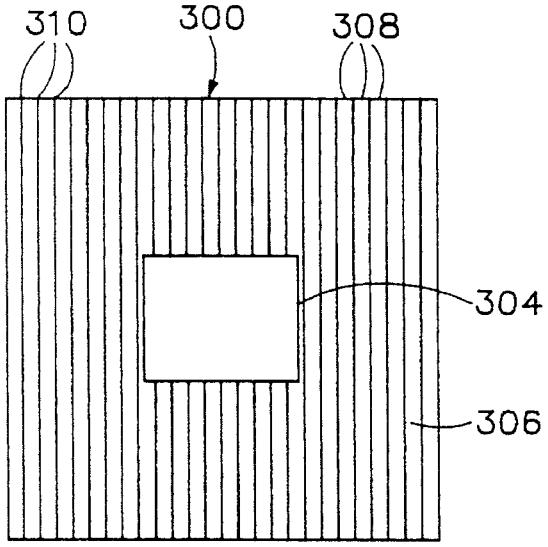
FIGS. 8A and 8B are two test images that are part of a series of test images used to compare the effectiveness of adaptive drive and inverted drive. The image in FIG. 8A is formed with no voltage applied outside of a gray square, and the image in FIG. 8B is formed by a maximum voltage applied to alternating vertical stripes.
Figure 8B:
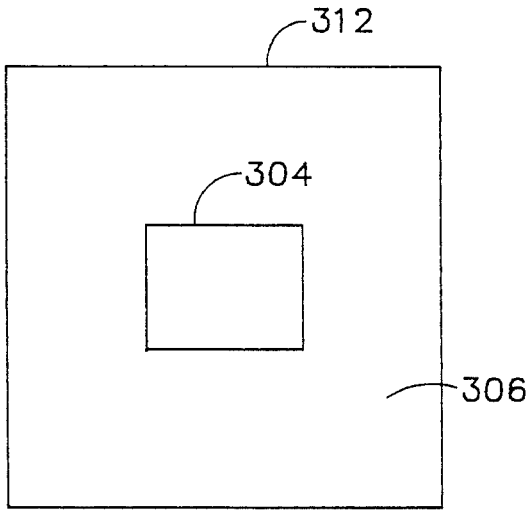

Adaptive drive can still be shown to be superior to DCD by measuring the optical transmission of a series of test images. FIG. 8A shows a typical test image 300 consisting of a gray area 304 surrounded by a region 306 composed of alternating light stripes 308 and dark stripes 310. The effect of crosstalk on the optical transmission of a pixel $\mathbf{16}^k_i$ in gray area 304 depends upon the voltage applied to electrodes 20 to form dark strips 310 and upon the voltage $V^k_i$ applied to pixel $\mathbf{16}^k_i$, i.e., the gray-scale level of pixel $\mathbf{16}^k_i$. The optical transmission through gray area 304 of the test image was measured as the voltage applied to form dark stripes 310 increased in steps from zero (FIG. 8B, a test image 312 showing no strips) to a maximum value (FIG. 8A, showing dark stripes). The side-to-side crosstalk increases with increasing voltage applied to form strips 310. The optical transmission was measured for images formed using adaptive drive, DCD, and a single phase, uncompensated drive. Both the adaptive drive and the DCD used a phase width of $\delta=½$. For the DCD scheme used, the complement voltage $W_m$ was chosen to be zero. Such a DCD scheme is known as "inverted drive" because the compensating signals are the inverse of the drive signals.

Figure 9:
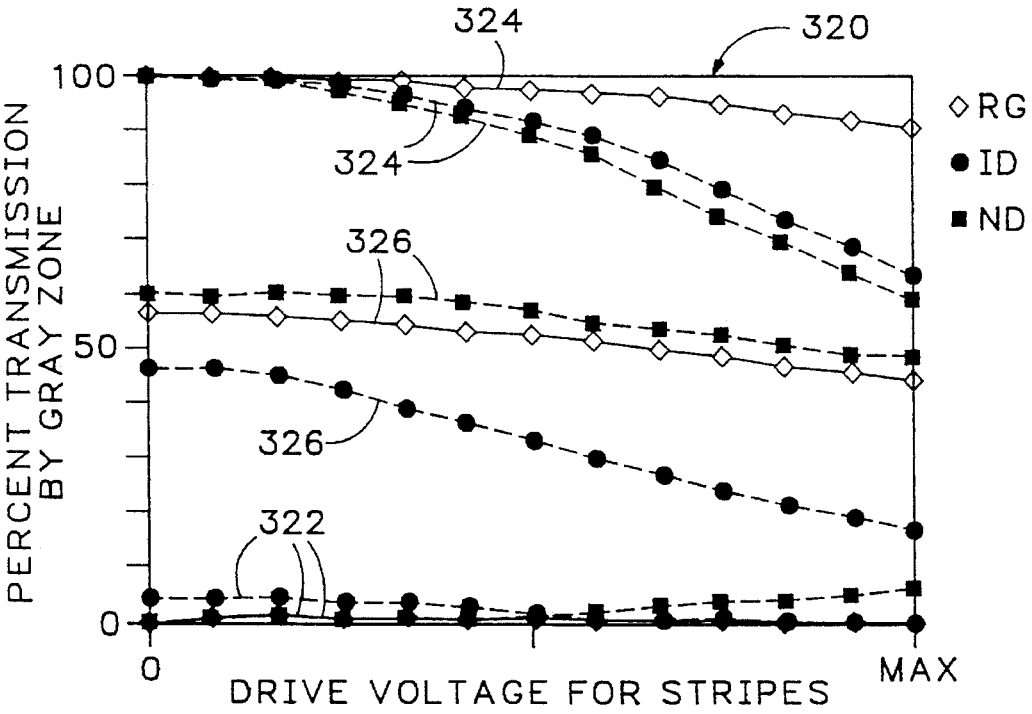
FIG. 9 is a graph showing the percentage of light transmission versus drive voltage for a series of test images, including the images shown in FIGS. 8A and 8B.

FIG. 9 is a graph 320 showing the measured optical transmission from gray area 304 of the test images as a function of the voltage applied to form dark stripes 310. The test display operates in the normally white mode, i.e., 100% transmission when no voltage is applied. The curves labeled RG, ID, and ND represent the optical transmission for the adaptive drive scheme, the inverted drive scheme, and the uncompensated drive waveform, respectively. The results for the three drive schemes are plotted as a set of three lines for each of three gray levels, or nominal transmission values, of gray area 304, each gray level corresponding to a different value of $V^k_i$. Sets of lines 322, 324, and 326 represent, respectively, approximately 2% transmission where $V^k_i$ is the maximum possible drive voltage 100% transmission where $V^k_i=0$, and 50% transmission. Deviations of the lines from the nominal transmission value is undesirable and is the result of crosstalk. The extent of the deviation of a line from the nominal value indicates the severity of a crosstalk problem.

The lines 322 for the three drive schemes plotted in FIG. 9 near the zero transmission axis show that there is little difference between the crosstalk reduction capability of the three drive waveforms for a pixel where $V^k_i$ is large and the transmission value is therefore close to zero. However, the lines 324 plotted near the 100% transmission line show that the adaptive drive scheme results in significantly less crosstalk than the inverted drive scheme or the uncompensated drive scheme when the pixel voltage $V^k_i$ is small and the drive voltage applied to form the dark stripes is large. The lines 326 plotted near the 50% line show that the adaptive drive scheme also results in less crosstalk at a medium value of $V^k_i$. Therefore the adaptive drive results in side-to-side crosstalk reduction equal or superior to that of DCD in cases of small, medium, and large values of $V^k_i$.

It is possible to compare front-to-back crosstalk reduction of the various drive schemes by considering an image having a high degree of horizontal symmetry and, therefore, no side-to-side crosstalk. In such an image, $V^{k-1}_j$, $V^k_i$, and $V^{k+1}_j$ are equal, and, therefore, $\Delta V^k_j=0$. In such a case the RMS voltage error of a data element $16^k_i$ driven by the adaptive drive scheme is equal to:

$$\text{Adaptive Drive } \langle V^2_{error}\rangle^k_i = \frac{1}{N}\sum_{j=1}^{N}\frac{\overset{\boxed{4}}{(V^k_j)^2}}{(C(\beta-\alpha))^2} \tag{12}$$

The minimum front-to-back RMS voltage error that can be produced by DCD results from $W_m=0$ (i.e. inverted drive) and is equal to:

$$DCD\langle V^2_{error}\rangle^k_i = \frac{1}{N}\sum_{j=1}^{N}\frac{\overset{\boxed{4}}{(V^k_j)^2}}{(C(\beta-\alpha))^2} \tag{13}$$

The minimum front-to-back RMS voltage error for RTC results when $W_c=0$ (also known as "Return to Ground" drive) and is equal to:

$$RTC\langle V^2_{error}\rangle^k_i = \frac{1}{2N}\sum_{j=1}^{N}\left(\frac{\overset{\boxed{4}}{(V^k_j)^2}}{(C(\beta-\alpha))^2}\right)+\frac{V^k_i}{N}-\left[\sum_{j=1}^{i-1}\left(\frac{\overset{\boxed{3}}{V^k_j}}{C^2\alpha(\beta-\alpha)}\right)+\sum_{j=i+1}^{N}\left(\frac{\overset{\boxed{3}}{V^k_j}}{C^2\alpha(\beta-\alpha)}\right)+\frac{\overset{\boxed{3}}{V^k_i}}{C^2\alpha(\beta-\alpha)}\right] \tag{14}$$

Comparing the RMS voltage errors of equations (12), (13) and (14), it can be seen that the adaptive drive scheme produces the identical fourth order error term as DCD, and RTC produces third-degree error terms. Therefore, the adaptive drive scheme reduces front-to-back crosstalk as well as DCD and better than RTC. Earlier, it was shown that the adaptive drive scheme reduces side-to-side crosstalk at least as well as RTC and better than DCD. The adaptive drive scheme thus reduces both types of crosstalk because the compensating signals are based upon multiple data drive signals. An adaptive drive scheme, unlike RTC, uses compensating signals that are based upon the data drive signals and, unlike DCD, uses compensating signals based upon multiple data drive signals.

It will be obvious to those having skill in the art that many changes may be made in the above-described details of the preferred embodiment of the present invention without departing from the underlying principles thereof. The scope of the present invention should, therefore, be determined only by the following claims.

We claim:

1. A driving method for an electro-optical addressing structure having an array of display elements defined by the intersections of plural data drive electrodes arranged in columns and plural data strobe electrodes arranged in rows, the display elements in a row storing in response to a data strobe signal applied to the data strobe electrode of the row data information corresponding to voltage values of data drive signals applied to the data drive electrodes during a row address period and display elements in subsequent rows storing data information corresponding to voltage values of data drive signals applied to the data drive electrodes during subsequent row address periods of a frame addressing period, the mean square average voltage across portions of each display element during the frame address period being incidentally affected by crosstalk, the method comprising:

determining for each row address period a compensating signal having a voltage value corresponding to voltage values of data drive signals applied to a first and at least one other data drive electrodes during the row address period; and applying the compensating signal to the first data drive electrode during a compensation phase of the row address period, whereby the compensating signal offsets much of the crosstalk to more accurately maintain a nominal mean square voltage value across portions of the display element during the frame addressing period.

2. The method of claim 1 in which the step of applying the compensating signal further comprises applying a single compensating signal to all of the data drive electrodes.

3. The method of claim 1 further comprising applying the same compensating signal to more than one data drive electrode.

4. The method of claim 1 in which the electro-optical display comprises an active matrix addressing structure of a liquid crystal type.

5. The method of claim 4 in which the display is of a plasma addressed liquid crystal type.

6. The method of claim 1 in which the compensating signal voltage value corresponds to the voltage values of the data drive signals applied to all of the data drive electrodes during the row address period.

7. The method of claim 6 further comprising applying a single compensating signal to all of the data drive electrodes.

8. The method of claim 1 in which the step of determining a compensating signal includes determining the inverse weighted average of the voltage values of all the data drive signals applied to the data drive electrodes during the row address period.

9. The method of claim 8 in which the step of determining the inverse weighted average is performed by a summing circuit of the analog type.

10. The method of claim 8 in which the step of determining the inverse weighted average is performed by digital calculations.

11. A driving method for an electro-optical addressing structure having an array of display elements defined by the intersections of plural data drive electrodes arranged in columns and plural data strobe electrodes arranged in rows, the display elements in a row storing in response to a data strobe signal applied to the data strobe electrode of the row data information corresponding to voltage values of data drive signals applied to the data drive electrodes during a row address period and display elements in subsequent rows storing data information corresponding to voltage values of data drive signals applied to the data drive electrodes during subsequent row address periods of a frame addressing period, the mean square average voltage across portions of each display element during the frame address period being incidentally affected by crosstalk, the method comprising:

applying the data drive signals to the data drive electrodes during a first phase of the row address period;

storing in the display elements of a row the data information corresponding to the data drive signals applied onto the data drive electrodes;

removing the data drive signals from the data drive electrodes; and substituting a compensating signal onto each of the data drive electrodes during a second phase of the row address period the compensating signal for each data drive electrode having a voltage value corresponding to the weighted average of voltage values of data drive signals applied during the row address period to the corresponding data drive electrode and to at least one other data drive electrode, whereby the compensating signal reduces crosstalk.

12. The method of claim 11 in which the step of substituting a compensating signal includes determining the compensating voltage value using an analog summing circuit.

13. The method of claim 11 in which the step of applying a compensating signal includes determining the compensating voltage value using digital calculations.

14. The method of claim 11 in which the electro-optical addressing structure comprises an active matrix display of the liquid-crystal type.

15. The method of claim 14 in which the active matrix display is of the plasma addressed liquid crystal type.

16. The method of claim 11 in which substituting a compensating signal onto each of the data drive electrodes includes substituting the same compensating signal onto more than one data drive electrode.

17. The method of claim 11 in which substituting a compensating signal includes substituting a compensating signal having a voltage value corresponding to the weighted average of the voltage values of the data drive signals applied to all of the data drive electrodes during the addressing period.

18. The method of claim 17 in which the compensating signals having the same voltage value are applied to all of the data drive electrodes during the addressing period.

19. An electro-optical addressing structure, comprising:

data drive electrodes for delivering data drive signals having voltage values to each of plural display elements arranged at address locations within an array; and a data driver for providing the data drive signals and a compensating signal to plural address locations within the array during respective first and second phases of an addressing period, the display element having incidental electrical couplings that carry incidental data components among the display element and the compensating signal provided to an individual address location during an addressing period having a voltage value determined from voltage values of the data drive signals applied to the corresponding data drive electrode and to at least one other data drive electrode during the addressing period.

20. The addressing structure of claim 19 in which the compensating signal is determined from the inverse weighted average of the voltage values of all of the data drive signals.

21. The addressing structure of claim 19 in which a single compensating signal is applied to all of the data drive electrodes.

22. The addressing structure of claim 17 in which the electro-optical addressing structure comprises an active matrix display of the liquid crystal type.

23. The addressing structure of claim 22 in which the display comprises an active matrix display of the plasma addressed liquid crystal type.

24. The addressing structure of claim 19 in which the compensating signal is determined from the voltage values of all of the data drive signals applied to the data drive electrode during the row addressing period.

25. The method of claim 24 in which the compensating signal is applied to all of the data drive electrodes.

* * * * *